US005191747A

United States Patent [19]

Tengquist et al.

[11] Patent Number: 5,191,747

[45] Date of Patent: Mar. 9, 1993

[54] PREFABRICATED PASS-THROUGH SERVICE SYSTEM FOR FAST FOOD RESTAURANTS AND THE LIKE

[76] Inventors: David C. Tengquist, 10721 Keithwood Pkwy., Richmond, Va. 23236; Patrick M. Kelly, 1133 Kittery Dr., Virginia Beach, Va. 23464

[21] Appl. No.: 696,861

[22] Filed: May 8, 1991

[51] Int. Cl.[5] ..... A47J 39/02

[52] U.S. Cl. ..... 52/36.4; 52/27; 108/50; 108/42; 312/242

[58] Field of Search ..... 52/36, 204, 206, 209; 109/58.5; 108/50, 42; 211/87, 90; 312/242, 236, 286; 392/363; 219/213, 214, 218, 385

[56] References Cited

U.S. PATENT DOCUMENTS

| | | | |
|---|---|---|---|
| 2,027,491 | 1/1936 | Percy | 52/36 X |
| 3,994,243 | 11/1976 | Anders | 52/476 X |
| 4,119,834 | 10/1978 | Losch | 219/214 X |
| 4,733,054 | 3/1988 | Paul | 219/385 X |

*Primary Examiner*—David A. Scherbel
*Assistant Examiner*—Robert Canfield
*Attorney, Agent, or Firm*—Staas & Halsey

[57] ABSTRACT

A prefabricated stainless steel appliance is provided for fast food restaurants that may be readily retrofitted into the preexisting pass-through openings in walls located between the kitchen area and the customer area. The appliance permits the serving of the customer with food with reduced personnel because of the elimination of frequent trips to the kitchen area from the customer area and return. The appliance includes an upper shelf for temporarily holding and keeping warm popular foods for readily serving.

9 Claims, 3 Drawing Sheets

PREFABRICATED PASS-THROUGH SERVICE SYSTEM FOR FAST FOOD RESTAURANTS AND THE LIKE

This invention relates to an improved delivery system for fast food restaurants and the like.

BACKGROUND OF THE INVENTION

In many fast food restaurants there is a wall that separates the area of cooking from the front where the customers are. This wall which separates the areas usually has an opening which includes a pass-through shelf. The opening varies in width but generally is on the order of 5' wide.

On the back side of the wall, in the kitchen area where the food is prepared, there is generally a bin or food warming area and once the food is prepared it will be put down into this bin and held there until it is put onto a plate which then is passed through to the front. This pass-through is elevated above the food preparation area and usually about 48" from the floor. The food warming bin is usually at counter height of approximately 36". Thus the food is normally prepared out of sight of the customer then put on a plate and lifted up to put on the shelf that is at the bottom of the pass-through. Then a server receives the plate on the customer side of the pass-through. Otherwise, the same person that put the plate on the pass-through would have to walk all the way around the wall to remove it from the shelf and bag it or prepare it for putting onto trays to serve to a customer. This normal procedure requires an additional person to operate the restaurant during slack time. During busy times there is sufficient clientele that all the workers are busy. If the restaurant has a high volume all of the time, no extra help is required. However, the customers are not present in the same high volume all day long such as occurs during lunch and dinner. In the afternoon periods and late in the evening, business may be quite slow and an extra person is still required just to keep the flow of the product moving. This invention is a recognition of that problem and a solution to it. Because of the heavy competition between fast food restaurants and their need to substantially cut cost, this extra labor is a substantial added operational expense.

DESCRIPTION OF THE PREFERRED EMBODIMENT

In this description, including the accompanying drawing, there is shown and described a preferred embodiment of the invention. It is to be understood that changes and modifications can be made in the preferred embodiment within the scope of the invention and that others skilled in the art will be able to make changes and modifications in a variety of forms, each as may be suited in the conditions of a particular case.

DETAILED DESCRIPTION OF THE INVENTION

Figure 1:
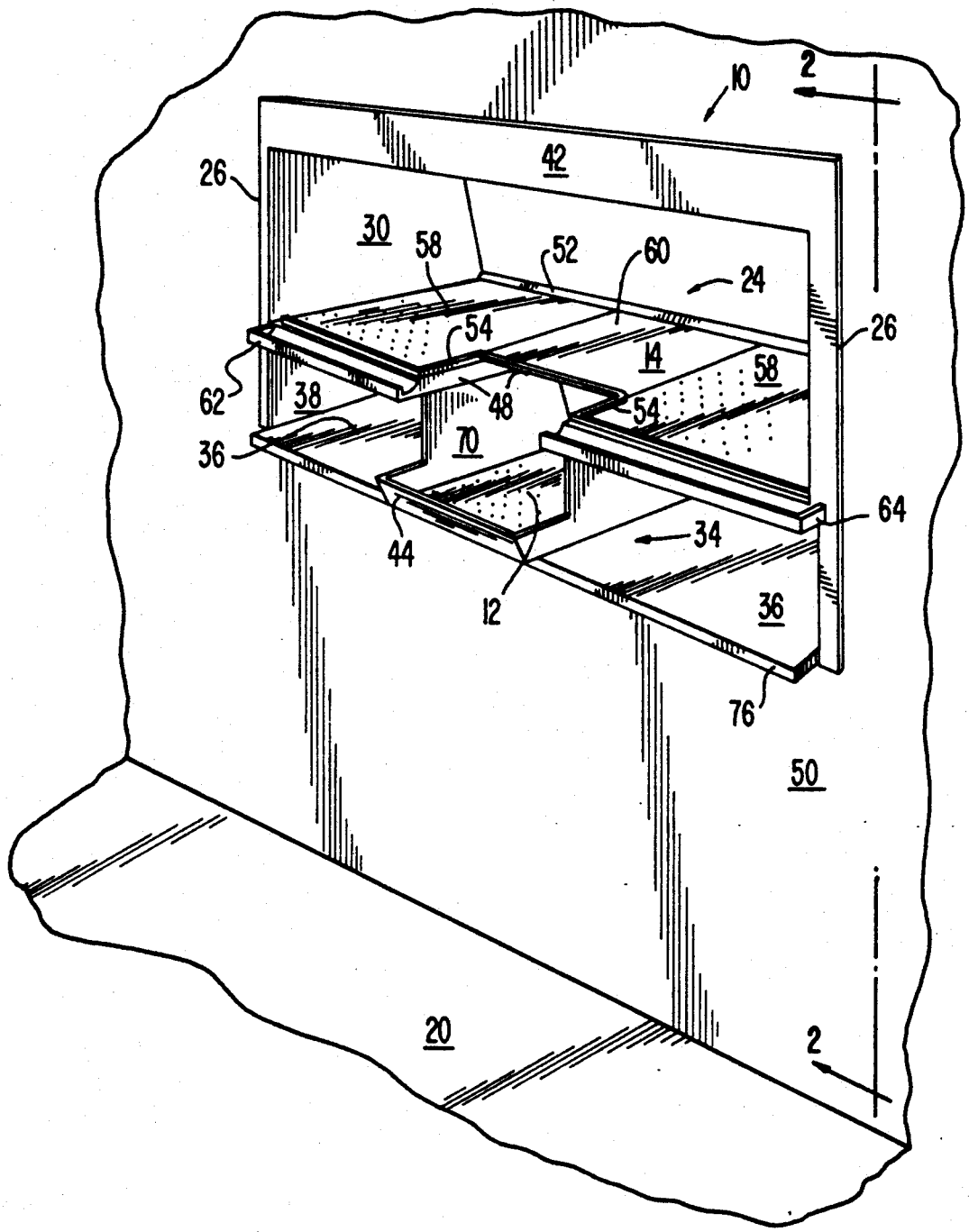
FIG. 1 is a perspective view of the present invention mounted in a wall as viewed from the kitchen side.

With reference to FIG. 1 a prefabricated pass-through apparatus or service system 10 is mounted in a wall 50 that separates the kitchen area 20 from the customer area 22 of restaurant such as a fast food restaurant. The kitchen area is where the cooking and most of the food preparation occurs and it is visibly separated for the most part from the customer area to the front of the restaurant. The customer area is where customers obtain and pay for their food, and some minor food preparation occurs. This is typically the situation in most fast food restaurants.

The prefabricated pass-through apparatus 10 is preferably made from stainless steel grade 301 which is a common type used for the food industry. It is made to restaurant standards by welding most of the panels to meet the standards of the National Sanitary Foundation (NSF). When manufactured to the NSF's standards, the apparatus is easy to clean when used with food products. While most of the components of the apparatus are welded together, some components may be bolted into place to provide for changeability and repairability. While the entire unit is preferably made into one piece by being prefabricated it also may be made into several subassemblies that are prefabricated which can be assembled at the job site.

The apparatus has an upper section 24 and a lower section 34. The upper section has an upper shelf 14 which is open both from the kitchen side and the customer side. Doors may be provided especially on the customer side that can be pivoted upward if desired. The pass-through upper shelf 14 has a rim 52 angled upwardly on the customer side and edging 54 on the side of a recessed cutout 48 on the kitchen side.

There are three grates laying on the pass-through upper shelf 14. These grates are in effect stainless steel shallow pans having perforated bottoms approximate ½" in depth which are turned upside down to place on the upper shelf. The three grates include two side grates 56 and 58 which extend the full depth of the shelf and one center grate 60 which extends from the recessed cutout 48 to the customer side of the upper shelf. The perforations in the inverted pans allow oil to drain from any oily products placed thereon. During cleaning these pans or grates are removed and cleaned separately then a squeegee or cloth is used to pull the oil drippings and any other debris to troughs 62 and 64 on the kitchen side for collection and removal.

The end of the troughs are open so that drippings can also drain into the fry bin 12. The upper section 24 also includes a section top 28 and sides 30 and 32.

Figure 2:
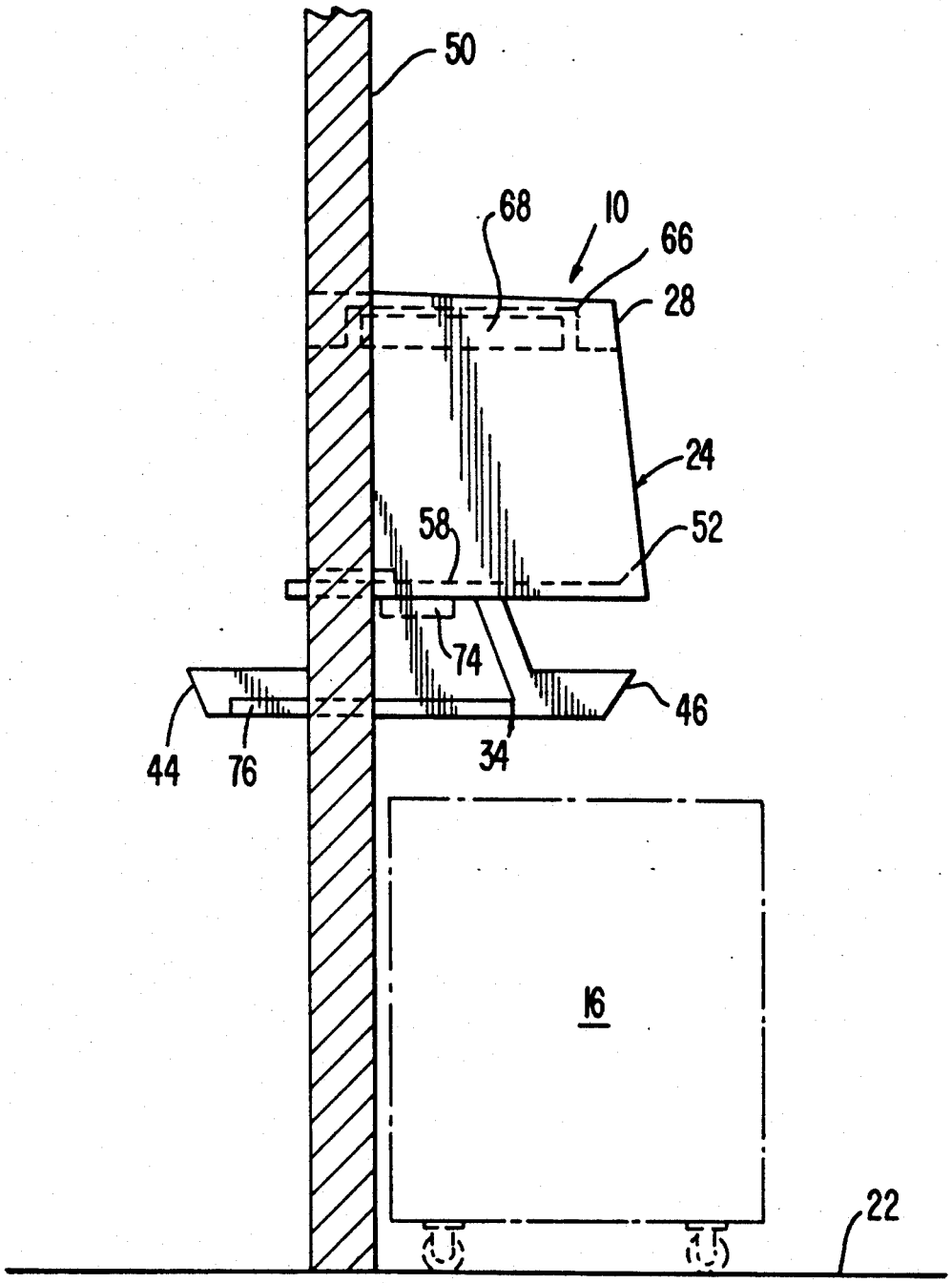
FIG. 2 is a cross section 2—2 of FIG. 1.
Figure 3:
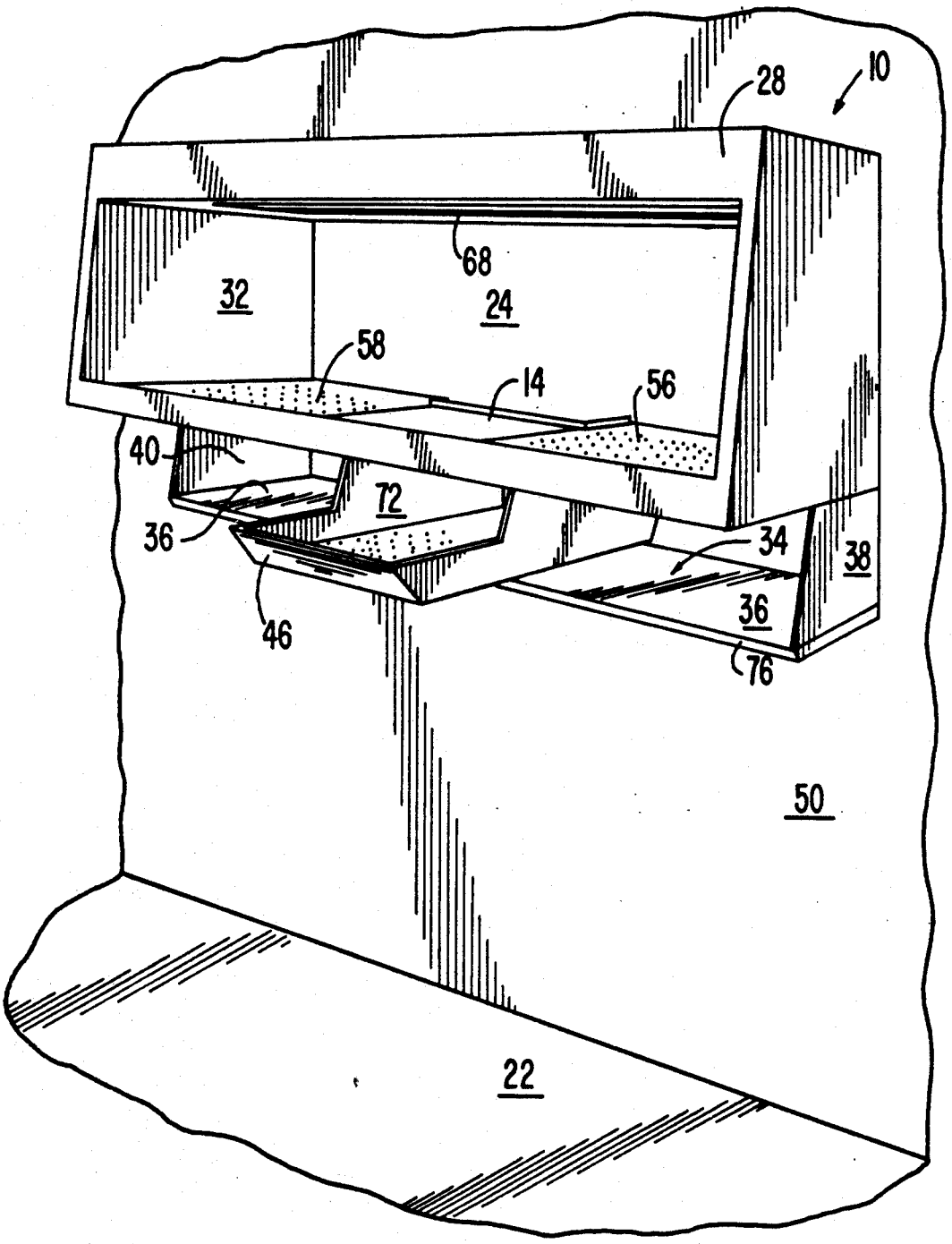
FIG. 3 is a perspective view of the present invention mounted in a wall as viewed from the customer side.

As seen in FIG. 3, a flange 26 is provided on each side of the service system 10 where it contacts the wall 50 on the kitchen side. Also, there is a wider flange 42 that contacts the same wall 50 on the kitchen side at the top of the upper section 24. The flange not only contacts the wall but covers the recessed portion of the upper section. As seen in FIG. 2, the upper section 24 is mostly flush with the wall 50 on the kitchen side but extends out into the customer side.

The recessed upper section top 28 is provided with heating elements 68 in this recessed area 66. These heating elements are to heat the food placed on the upper shelf while it is being temporarily held there. Usually the heating elements are two high intensity food warming units and may include lighting to simultaneously light the food. Suitable heating units are available from several sources, one of the preferred types is the Glo-Ray (trademark) available from Hatco Corporation, 635 S. 28th St., Milwaukee, Wis. 53215.

A lower section 34 includes a lower shelf 36. As shown in FIG. 1 there is both a shelf area on the left and right of the fry bin 12, but in some configurations the fry bin and recess cutout 48 can be at one side of the service system 10 with the shelf extending the remainder of the width of the service system. The lower shelf is used for passing through trays and the like and is accessible both from the kitchen side and the customer side. Obviously other materials may be passed through on the shelves other than trays.

The lower section has side 38 and side 40 which extend in the same plane from the upper side 30 and 32. The lower shelf includes a rim or edge 76.

Mounted in the middle of the lower section 34 is a fry bin 12. While this bin is primarily usable for french fries it is also usable for other types of food where it is desired that the food be maintained separately from the food held on the upper shelf. The bin 12 has a kitchen area accessible end 44 as shown in FIG. 1 and a customer area accessible end 46 as shown in FIG. 3. Each of these ends have an angled outward endwall and vertical sidewalls of the same height as the endwall.

The sidewalls 70 and 72 have a height extending from the bottom of the bin to the upper shelf 14. The kitchen side of the bin has the full height of the bin sidewalls extending generally to the edge of the wall as shown in FIG. 1 but the sidewalls only come outward on the customer side approximately half way under the upper shelf as seen best in FIG. 2 and FIG. 3. The french fry bin 12 may also be referred to as the food warming bin since other food may be placed therein when it is desirable that it be readily accessible, warm and that it be separated from the food temporarily placed on the upper shelf. Thus the bin does not extend past the outer projections of the service system on the customer side but yet is readily accessible for reaching in and obtaining the food located there. On the kitchen side the bin is located under the recessed cutout 48 and projects into the kitchen area. When the bin is used for french fries which are usually cooked in wire baskets in oil, the baskets with the cooked french fries are lifted from the oil, shaken, permitting the oil to drain and then are normally tossed into the bin. The recessed cutout 48 and the projection into the kitchen of the bin cooperate so the cooking basket can be readily dumped into the bin. It is to be noted that the bin underlies the edge of the two cleaning troughs 62 and 64 so material will drain into the bin from the troughs either by gravity or by being pushed there by a cleaning rag.

A heating element 74 as shown in FIG. 2 is located above the bin to warm the food placed therein. The heating element may also include lights. The heating element can be similar to the type available from Hatco Corporation as mentioned earlier, except those used in warming the bin would of course be shorter. The lower shelf 36 projects into the kitchen area as seen in FIGS. 1 and 2 and also projects into the customer area as seen in FIGS. 2 and 3. Suitable lights may be provided to light the lower shelves or countertop. The lower shelf may extend further into the kitchen area than shown to provide additional countertop and plates can be stacked below the shelf on any suitable kitchen equipment located under the shelf (not shown). Generally the lower shelf extends the full width of the service system and the bin is located in the middle or at one end on top of the lower shelf and is secured in place by screws either to the underside of the upper shelf or the lower shelf or both. The lower shelf is usually secured to the upper section by screws so that it can be removed and other apparatus such as a steam table or other future improvements inserted at least in part.

The service system is preferably made of 14 and 16 gauge 301 stainless steel usually the upper section being made of the heavier gauge and the lower section being made of the lighter gauge. The upper shelf is usually approximately 48" from the floor and the food warming bin is approximately 36" from the floor. The width of the service system is approximately the same width of a preexisting pass-through opening in the wall if it is being retrofitted to an older building. This would usually be approximately 60" in width. If it is for a new building the width would be as desired but normally it would be 8' or less. The depth would normally be a maximum of 36" and preferably approximately 30". The height would normally be around approximately 31" from top to bottom.

In the case of preexisting buildings the existing pass-through is normally 16" high located about 48" from the floor with a width of approximately 5'. Usually it is located in the wall that is a substantial distance from the nearest door in the wall. Therefore, when it is necessary to go from the kitchen area to the customer area there is a travel distance of approximately 36' normally involved.

The greatest use of the invention is in retrofitting existing fast food restaurants. This is accomplished by leaving the opening that already exists at approximately the same width but enlarging the vertical height of the opening by going up and down to enlarge the opening to approximately 31" in height. Next, the service system 10 is slid in place from the kitchen area until the flanges 26 contact the wall 50 on the kitchen side and then the apparatus or service system is fastened into place by screwing either the flange 26 or the inner walls 30 and 32 or both to studs or other supports in the wall on either side of the enlarged opening. Next, an electrical connection is made for the lights and heaters. Installation can usually be accomplished for most restaurants between the normal quitting time and before breakfast the next morning so installation does not require that any time be lost during business hours.

By not increasing the width of the pre-existing opening there is no interference with electrical cables and plumbing that may be in the wall on both sides of the opening. Generally this is not a problem with any plumbing or electrical wires above and below existing pass-through openings.

The economics of the service system 10 are such that it may pay for itself in approximately six months. It can be rapidly installed with minimum cost during times when the restaurant is normally closed. There is no need to cut the tops of counters prior to installation.

The apparatus 10 of the present invention provides access to a prepared food product from both the customer side and the kitchen side and separates the usual products such as fish and chicken from other products such as french fries and provides a means for passing trays and/or plates from the customer side to the kitchen side where food can be dished out and passed back through the front. The apparatus is designed to only occupy a limited space and not interfere with existing equipment. Furthermore, the apparatus permits reduced labor because of the elimination of the need for a fourth person. This fourth person is usually only needed part time, generally for a few hours in the morning and a few hours in the evening during peak periods and this type of personnel is usually difficult to find. Also, the apparatus gives a customer a perception of prompt service even if the fourth person is not used. Usually three people are needed: a cook, a cashier and a management person.

When using the apparatus with only three people, the food product which is most popular is generally prepared and placed on the food warming pass-through upper shelf 14. There may be a holding time on the shelf of 20 to 25 minutes for some of the food products. Those products needing separation such as french fries can be located in the bin 12. The placing of the food products on the food warming upper shelf also serves as a merchandising tool since the customers can view the food products from the customer area. Generally, the products are heated to a minimum of 140 degrees fahrenheit while on the shelf. Preferably, air flows over the product while on the shelf to prevent moisture from increasing.

When the food is served to the customer it is taken down from the upper shelf and any products ordered that are in the bin are added. If ice cream and the like is also ordered, it may be taken from the reach-in refrigerator 16 located on the customer side under the apparatus 10. The customer is then served with the food. All of this is accomplished without the need for the serving personnel to go from the customer area to the kitchen area and back. Of course, if special items are ordered they can be handled on a custom basis as in the past.

The invention may also be utilized in new construction which has most of the same advantages described above except some of the advantages that make for easy retrofitting is, of course, not required for new construction.

It is to be understood that the following claims are intended to cover all of the generic and specific features of the invention herein described and it is to be understood that this specific embodiment herein shown is not to be construed in the limiting sense but is merely to depict and illustrate the principles of the present invention. Modifications may be devised by those with skill in the art which will not depart from the spirit or scope of protection as set forth in the following claims.

What is claimed is:

1. A prefabricated pass-through apparatus for installation in the walls of restaurants between the kitchen area and the customer area comprising:

an upper section including an upper shelf forming the bottom of said upper section, and extending substantially the entire width of said upper section for temporarily holding and passing through of food from the kitchen area to customer area;

a top for said upper section, two sides for said upper section connecting said top and said upper shelf;

a lower pass-through section having a lower pass-through shelf;

two sides for said lower section extending downward from said upper section sides;

a bin for food such as french fries located at said lower pass-through section having an accessible end from the kitchen area side and an accessible end from the customer area side; and a recessed cut-out in said upper shelf located over said bin on the kitchen area side for making more accessible the placing of food into said bin.

2. The apparatus of claim 1 wherein:

at least one perforated removable grate lays on the top of said upper shelf; and at least one trough is provided at an edge of said upper shelf into which oil and debris may be wiped from said upper shelf into said trough.

3. The apparatus of claim 2 wherein:

a flange is provided on each of said sides of said upper section permitting said upper section to slide through an opening in a wall until the sliding is arrested by said flange contacting said wall.

4. The apparatus of claim 3 wherein:

a food warming heater is recessed into said top of said upper section to warm food temporarily placed on said upper shelf.

5. The apparatus of claim 4 wherein:

a heater is located under said upper shelf and over said bin to heat any french fries or other food placed therein.

6. The apparatus of claim 5 wherein:

an opening is provided at one end of said trough which opening overlies said bin so material can drain or be wiped from said trough and fall into said bin.

7. The apparatus of claim 1 wherein:

a flange is provided on each side of said upper section permitting said upper section to slide through an opening in a wall until the sliding is arrested by said flange contacting said wall.

8. The apparatus of claim 7 wherein:

a food warming heater is recessed into said top of said upper section to warm food temporarily placed on said upper shelf.

9. The apparatus of claim 8 wherein:

a heater is located under said upper shelf and over said bin to heat an french fries or other food placed therein; and at least one trough is provided at an edge of said upper shelf into which oil and debris may be wiped from said upper shelf into said trough; and an opening is provided at one end of said trough which opening overlies said bin so material can drain or be wiped from said trough and fall in said bin.

* * * * *